US006155929A

United States Patent [19]

Chipman

[11] Patent Number: 6,155,929

[45] Date of Patent: Dec. 5, 2000

[54] LASER AIMED CUE STICK

[76] Inventor: Max C. Chipman, 951 Finchwood La., Las Vegas, Nev. 89110-2703

[21] Appl. No.: 09/114,014

[22] Filed: Jul. 10, 1998

Related U.S. Application Data

[60] Provisional application No. 60/052,320, Jul. 11, 1997.

[51] Int. Cl.[7] ..... A63D 15/08

[52] U.S. Cl. ..... 473/2; 473/44

[58] Field of Search ..... 473/2, 45, 44, 473/46, 220, 49; 362/102, 109, 120

[56] References Cited

U.S. PATENT DOCUMENTS

| | | |
|---|---|---|
| 3,389,911 | 6/1968 | Castiglione, Jr. . |
| 4,688,796 | 8/1987 | Wright . |
| 4,882,676 | 11/1989 | Van De Kop et al. . |
| 4,911,450 | 3/1990 | Rabold . |
| 5,275,398 | 1/1994 | Compton . |
| 5,338,262 | 8/1994 | Hayes . |
| 5,401,215 | 3/1995 | Pfost . |
| 5,435,562 | 7/1995 | Stock . |
| 5,554,075 | 9/1996 | Glazer . |
| 5,558,584 | 9/1996 | Brown . |
| 5,593,354 | 1/1997 | Falossi . |
| 5,725,440 | 3/1998 | Finney . |
| 5,733,202 | 3/1998 | Vargo . |
| 5,924,934 | 7/1999 | Hamilton . |

*Primary Examiner*—Sebastiano Passaniti
*Attorney, Agent, or Firm*—Kenehan & Lambertsen, Ltd.; John C. Lambertsen

[57] ABSTRACT

A cue stick is provided having a laser sighting mechanism that is in precise alignment with the longitudinal axis of the cue stick. A laser unit is placed within the cue stick, at a location that is substantially adjacent to the cue tip. An aperture is formed in the center of the cue tip, such that the opening through which the laser light will emerge is coaxial with the longitudinal axis of the cue stick. A sufficient number of storage batteries are also located within the cue stick, and an activation switch is provided to selectively energize the laser unit when an emission of laser light though the cue tip aperture is desired.

5 Claims, 1 Drawing Sheet

LASER AIMED CUE STICK

CROSS-REFERENCE TO RELATED APPLICATION

This application claims the benefit of U.S. Provisional Application, Ser. No. 60/052,320, filed Jul. 11, 1997.

BACKGROUND OF THE INVENTION

1. Field of the Invention

The present invention relates to pool and billiard games, and more particularly, to an apparatus designed to improve accuracy in the play of pool and billiards. More specifically, the present invention relates to a billiard cue stick having a laser-aiming device mounted along the central axis of the cue stick.

2. Description of the Prior Art

For over seven hundred years one or more players have attempted to control the movement of balls about pool and billiards tables. The majority of such games require the player to either precisely position the balls at particular locations on the tables, or to place the balls within one of several "pockets" that are provided about the periphery of the table playing surface.

Having reached a peak in the 1950's, the number of pool and billiards players, as well as playing locations, entered a steady decline throughout the 1960's and 1970's. The strong economy of the mid-1980's combined with rapidly increasing numbers of young adults in their 20's and 30's saw the opening of a number of upscale pool and billiards parlors. Not only did the number of players in absolute terms increase, the demographics of such players saw a marked increase in the number of women. Initially making up no more than 10% of all players, by the end of the decade the percentage of women playing pool had increased to 33%. Billiards by then had become the third most popular sport in the country, with almost 39 million people having participated at least once during the 1980's.

Requiring only minimal levels of physical exertion, pool and billiards games permit competition and participation by people of all ages and skill levels. The challenge for all relates to the difficulty in successfully coordinating the consecutive execution of two difficult activities. The player must first determine both the desired path the ball is to follow, and at what velocity. Immediately thereafter, the player must accurately coordinate hand and arm movement so that the pool stick or "cue" impacts the pool ball at the proper location and with sufficient force as to result in propulsion of the ball in the manner desired. Further complications in this process can occur when it becomes necessary to rebound the cue ball off of a side rail cushion in order to strike another ball in the manner desired so as to direct the second ball in the proper direction and at the proper speed.

On average, only 20% to 30% of pool hall players own their own cue stick. While the majority of pool players are apparently willing to rely upon the generic, well-used cue sticks provided along the wall of most pool establishments, serious pool players have always understood the value of a good custom cue stick. The worlds largest manufacturer of quality two-piece custom billiards cues, McDermott Cue Manufacturing of Menomonee Falls, Wis., manufactures a wide variety of cue designs from a broad range of materials, including wood, vulcanized fiber, and plastics. Hard rock maple is prized for cue shafts due to its straight grain. Exotic woods, such as ebony, Brazilian rosewood, bacote, zircote, cocobolo, and tulipwood are used for decorative inlays. With prices ranging from $165 to $2,000 for the basic line of cue sticks, adding diamond or gold inlays can increase prices up to $5,000. Cue sticks manufactured by such individual craftsman as George Balabushka, Gus Szamboti, and Bill Stroud are widely considered to be collector items, with prices reaching as high as $20,000 or more.

While seemingly easy in the abstract to aim a cue ball to collide with an object ball at the correct location to cause the desired post-collision trajectories of cue and object balls, the realities of the pool table conspire to make this task not always so easy. In fact, when a shot does not create the desired results, the nature of the problem isn't always apparent. Was the shot missed as a result of incorrect aiming or was the error due to aiming correctly, but mis-addressing the cue ball with the cue stick?

When attempting to upgrade skill levels, there are times when even achieving the desired result can be detrimental. For example, an incorrect aim may, in combination with an erroneous striking of the cue ball, result in a successful shot. Here as well, two wrongs do not make a right, and such training confusion can prolong the period required to improve skills.

Prior efforts to assess initial aim and resultant billiard ball placement have included such (relatively) complex apparatus for tracking ball movement as are described in U.S. Pat. No. 4,882,676 to Van De Kop, et al. In addition to calculating the optimal path of a cue ball prior to a shot being made, it will also project a laser-generated image onto a pool table that outlines the desired path of the cue ball.

In Compton, U.S. Pat. No. 5,275,398, a bracket-mounted laser unit is attached to a cue stick. The bracket is adjustable, with the desired end result having the laser beam pass one-quarter to one-half inch over the cue ball. In Glazer, U.S. Pat. No. 5,554,075, a laser unit is more closely mounted to the shaft of a cue stick. A portion of the laser beam is directed generally parallel to the cue stick, with at least a portion intended to strike the cue ball. A beam deflector is mounted between the laser unit and the cue tip, deflecting a portion of the laser beam up and away from the cue stick. This deflected portion passes over the cue ball, parallel to the pool table, to illuminate another ball or shine upon a reflector mounted above a side cushion of the pool table.

None of these proposed solutions provide a cue stick that can be used in a conventional manner—while also providing a laser beam that accurately depicts both the cue stick location of impact as well as the resultant path of the cue ball. Not only does a bracket mount make use of the cue stick unwieldy, it requires careful orientation of the round cue stick to assure the laser beam mechanism generates an accurate illuminated pathway.

SUMMARY OF THE INVENTION

It is an object of the present invention to provide a cue stick that can be used in a conventional manner to strike balls, as well as to lay out (plan) future shots, while providing the enhanced benefit of a laser beam alignment feature. In this regard, a laser unit is placed within a housing formed within the cue stick. An aperture located in the center of the cue tip is provided to permit the emitted laser beam to exactly track the central longitudinal axis of the cue stick itself.

In addition to providing a laser beam that may be more accurately used to determine post-impact ball paths, the emission of the laser light from the center of the cue tip enables greater accuracy when striking the cue ball. Emission along the central axis permits an easy determination of the impact location on the cue ball surface up until immediately prior to impact with the cue tip. This ability to select the desired impact point after carefully calculating the desired cue ball path, and then maintain aim on this "target" area throughout the shot-making stroke results in better directional control and predictability of the resultant cue ball path. Such aim control also provides an enhanced ability to induce the desired spin characteristics imparted when striking the cue ball.

Some further objects and advantages of the present invention shall become apparent from the ensuing description, and as illustrated in the accompanying drawings.

DETAILED DESCRIPTION OF THE PREFERRED EMBODIMENTS

Figure 1:
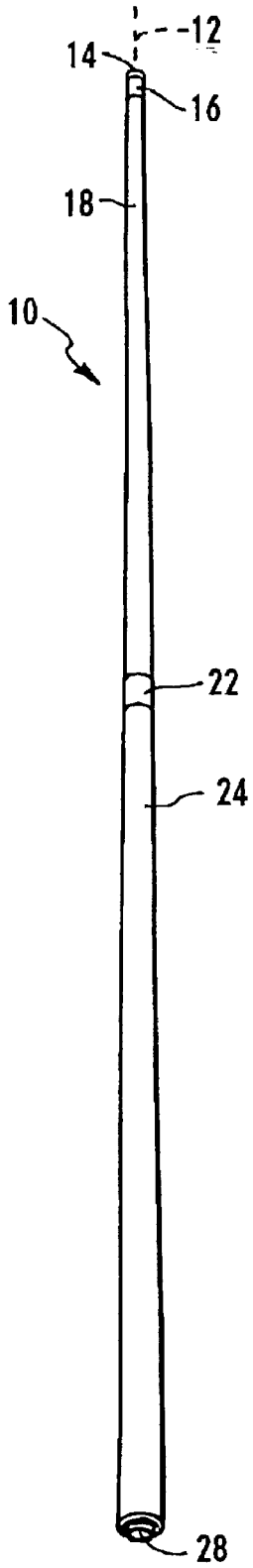
FIG. 1 is a perspective view of a billiards cue, having a representational laser beam shown being emitted from a tip thereof, in accordance with the present invention.

Reference is now made to the drawings wherein like numerals refer to like parts throughout. A laser aimed cue 10 is shown in FIG. 1, with a laser light beam 12 representationally shown emanating from a tip 14 of the laser aimed cue 10. The tip 14 is attached to a ferrule 16 that overlies an end of a shaft section 18, providing reinforcement to help prevent the splitting thereof—particularly when the shaft section 18 is fabricated out of wood or has an outer wood surface layer.

For ease of transport, all custom cues are of a two-piece design. As is shown in FIG. 1, a joint 22 is formed in the area of attachment between the shaft section 18 and a butt section 24. An activation switch 28 is preferably located at a terminus of the butt section 24 of the laser aimed cue 10, and controls the activation thereof.

Figure 2:
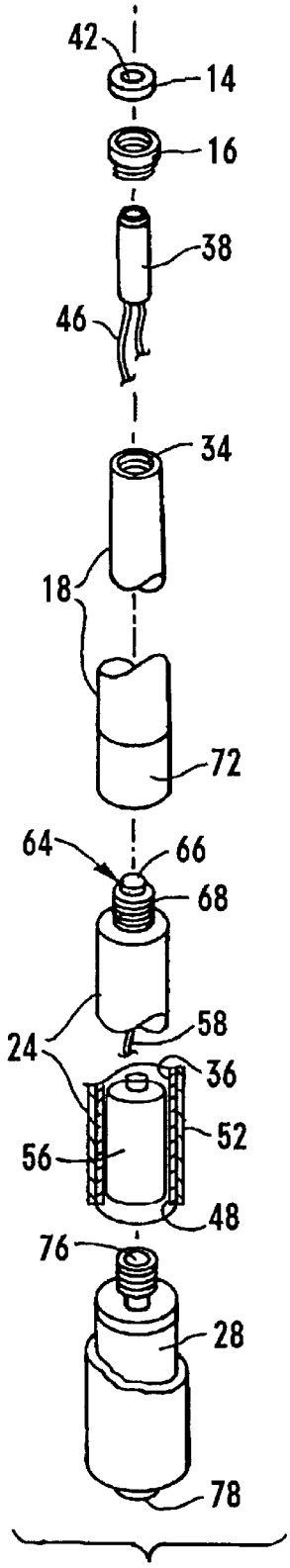
FIG. 2 is an exploded, partial prospective view, with portions in cross section and portions broken away, showing a laser aimed cue stick in accordance with the present invention.

Turning now to FIG. 2, both the shaft section 18 and the butt section 24 have a shaft and a butt throughbore 34, 36, respectively, formed therein. A laser unit 38 is mounted within the shaft throughbore 34 at a location that is substantially adjacent to the tip 14. Upon activation, the laser unit 38 generates laser light energy that is directed toward the tip 14, which has a centrally located aperture 42 formed therein to permit passage of the laser light energy through the otherwise solid tip 14.

In order to provide effective aiming information it is critical that the tip aperture 42 be precisely located on the central axis of the tip 14 and that the laser unit 38 and the tip 14 be coaxially located with respect to one another. The diameter of the tip aperture 42 also governs the laser beam size and brightness. While such considerations might cause some range of variances in tip aperture sizes, an aperture diameter of 3/32" is presently viewed as being generally appropriate for the majority of cue applications.

Electrical power is supplied to the laser unit 38 through a pair of lead wires 46. As is depicted in FIG. 2, the shaft section 18 is fabricated out of aluminum, and the butt section 24 consists of an inner core 48 of aluminum and an outer covering 52 of a non-conducting plastic. When attached together, the aluminum shaft section 18 and the inner aluminum core 48 form an electrically conductive shell structure, to which one of the lead wires 46 may be attached, creating a common ground.

A dry cell battery 56 is shown located within the butt throughbore 36 of the butt section 24, with a connective wire 58 extending from the dry cell battery to a single pole electrical connector 64 located at a terminus of the butt section 24 that is opposite from the activation switch 28. Having a central metal contact 66 extending from an insulating nylon insert 68, the single pole electrical connector 64 is received within and makes electrical contact with a female electrical connector 72 attached to a terminus of the shaft section opposite that of the tip 14. The single pole electrical connector 64 and the female electrical connector 72 preferably comprise a threaded connection, thereby forming a sound structural connection, as well as an electrical connection that is reliably conductive.

The activation switch 28 is located at a terminus of the butt section 24, opposite that of the single pole electrical connector 64. The activation switch 28 is provided with a projecting electrical contact 76 of a design to insure a reliable electrical connection with a pole of the dry cell battery 56. A spring-loaded button 78 is provided to cycle the activation switch between its open and closed positions.

In a presently preferred embodiment, the laser aimed cue 10 is a hollowed aluminum core that continuously extends throughout the shaft and butt sections. The outer covering 52 is a plastic composite material selected to provide a surface that is pleasant to touch as well as having an appropriate coefficient of friction to enable the accurate, non-slip use of the cue when stroking at the ball.

To ensure that the laser light source provides an aiming beam of great accuracy, it is most important that substantially no amount of flexure exist in the shaft section 18 between the laser unit 38 and the tip 14. It is consequently of great importance to utilize a laser unit of a size that permits placement of the laser unit substantially adjacent to the cue tip.

A visible diode laser, such as those manufactured by the Quarton division of Fidelity International Technologies, Edison, N.J., are viewed as being appropriate for use in the present invention. Having a diameter of approximately 8 mm in width by 22 mm in length, such laser units are placed within 22 mm of the cue tip. The laser unit is maintained in position by being wedged between a shoulder formed towards the tip end of the shaft section and a receiving cap formed in the ferrule.

Power for such a laser unit requires only two conventional AAA dry cell batteries. The activation switch can likewise be a simple, spring-loaded on/off switch of the type as are manufactured/sold by Radio Shack for use as a full time on/off switch.

Conventional custom cues are approximately 58½" long when assembled, with a butt section normally 29½" and a shaft section of 29½". If tapered, as most cues are, such custom cue sticks will expand from a ½" diameter at the tip end to a diameter of 1¼" at the terminus of the butt section.

To best accommodate the dry cell batteries, it is preferred that a separately-fabricated battery housing be placed within the hollowed cue stick, at a location substantially adjacent the on/off activation switch. Although the Figures depict the position of such a switch at the terminus of the butt section, positioning of the battery housing and activation switch is a matter of design choice, with the limit of its position determined primarily by the diameter of dry cell batteries required to operate the laser unit. Additionally, although depicted in the Figures as having an outer, aluminum shell ground, it is also possible to construct a circuit where both leads from the laser unit extend to appropriate locations on the activation switch.

My invention has been disclosed in terms of a preferred embodiment thereof, which provides an improved laser aimed cue that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. An improved cue stick of the type having a central longitudinal axis and a handle end and an opposing tip end, wherein the improvement comprises:

a housing formed in an interior portion of the cue stick;

a laser unit received within said housing at a location immediately adjacent said tip end;

a retaining ring removably attached to said cue stick at said tip end; and a cue tip attached to said retaining ring, said cue tip having a centrally-located aperture formed therein, whereby the removable retaining ring to which the cue tip is attached provides immediate access to the laser unit for cleaning or replacement.

2. An improved cue stick as described in claim 1, wherein said cue stick has a central longitudinal axis and wherein the aperture of said cue tip is substantially coaxial with said central longitudinal axis.

3. An improved cue stick as described in claim 2, wherein said laser unit is positioned within said housing in laser light communication with said aperture of said cue tip, whereby upon emission of laser light energy from said laser unit, such laser light energy is emitted from said housing within said cue stick through said aperture.

4. An improved cue stick as described in claim 3, wherein said laser unit is positioned within said housing in a manner that places said laser unit substantially coaxial with said central longitudinal axis of said cue stick.

5. An improved cue stick as described in claim 4, and further comprising an activation switch located at a terminus of said handle end and in electrical communication with said laser unit.

* * * * *